US011721941B2

(12) United States Patent
Thomasse et al.

(10) Patent No.: US 11,721,941 B2
(45) Date of Patent: Aug. 8, 2023

(54) BACKSHELL WITH ELECTROMAGNETIC PROTECTION

(71) Applicant: SAFRAN ELECTRICAL & POWER, Blagnac (FR)

(72) Inventors: David Thomasse, Moissy-Cramayel (FR); Jérôme Genoulaz, Moissy-Cramayel (FR); Jean-Luc Cottin, Moissy-Cramayel (FR)

(73) Assignee: SAFRAN ELECTRICAL & POWER, Blagnac (FR)

( * ) Notice: Subject to any disclaimer, the term of this patent is extended or adjusted under 35 U.S.C. 154(b) by 268 days.

(21) Appl. No.: 17/413,753

(22) PCT Filed: Dec. 13, 2019

(86) PCT No.: PCT/FR2019/053060
§ 371 (c)(1),
(2) Date: Jun. 14, 2021

(87) PCT Pub. No.: WO2020/128254
PCT Pub. Date: Jun. 25, 2020

(65) Prior Publication Data

US 2022/0052493 A1 Feb. 17, 2022

(30) Foreign Application Priority Data

Dec. 17, 2018 (FR) ..... 1873100

(51) Int. Cl.
*H01R 13/6592* (2011.01)

(52) U.S. Cl.
CPC ..... *H01R 13/6592* (2013.01)

(58) Field of Classification Search
CPC ..... H01R 13/6592; H01R 13/65918
(Continued)

(56) References Cited

U.S. PATENT DOCUMENTS 4,579,415 A 4/1986 Van Brunt et al.
5,052,947 A * 10/1991 Brodie ..... H01R 13/65918 439/578

(Continued)

FOREIGN PATENT DOCUMENTS

EP 0 160 465 A2 11/1985
EP 0 874 420 A2 10/1998

(Continued)

OTHER PUBLICATIONS

International Search Report dated Apr. 2, 2020 in PCT/FR2019/053060 filed on Dec. 13, 2019 (2 pages).

(Continued)

*Primary Examiner* — Peter G Leigh
(74) *Attorney, Agent, or Firm* — Oblon, McClelland, Maier & Neustadt, L.L.P.

(57) ABSTRACT

A backshell for connecting an overall-shielded harness including shielded cables to a connector, the backshell including a sleeve having a full toothed ring, a first external area for receiving the terminations of the shielding, and a second external area for receiving the overall-shielding of the harness, the backshell further including an attachment ring having a first internal area and arranged so that it can slide over the sleeve up to an abutment position in which it covers the first external area of the sleeve so as to cover the terminations of the shielding. This backshell is designed to make a terminated shielding harness and a connection protected against EM interference between the terminated shielding harness and a connector.

10 Claims, 2 Drawing Sheets

(58) Field of Classification Search
USPC ..... 439/607.53
See application file for complete search history.

(56) References Cited

U.S. PATENT DOCUMENTS

| | | | | |
|---|---|---|---|---|
| 5,807,138 | A * | 9/1998 | Guiol | H01R 9/0521 439/607.41 |
| 6,194,654 | B1 | 2/2001 | Buehler et al. | |
| 6,276,967 | B1 * | 8/2001 | Hall | H01R 13/65918 439/607.41 |
| 6,339,193 | B1 * | 1/2002 | Goett | H01R 9/0512 174/78 |
| 9,209,571 | B2 * | 12/2015 | Myong | H01R 13/5808 |
| 2004/0121650 | A1 * | 6/2004 | Lazaro, Jr. | H01R 13/65912 439/598 |

FOREIGN PATENT DOCUMENTS

| | | | | |
|---|---|---|---|---|
| FR | 3046885 | A1 * | 7/2017 | H01R 13/65918 |
| FR | 3055033 | A1 * | 2/2018 | H02G 3/32 |
| GB | 0724310 | B1 * | 7/1996 | H01R 13/65918 |

OTHER PUBLICATIONS

Preliminary French Search Report dated Sep. 24, 2019 in FR 1873100 filed on Dec. 17, 2018 (2 pages).

* cited by examiner

BACKSHELL WITH ELECTROMAGNETIC PROTECTION

TECHNICAL FIELD

The invention relates in general to a backshell. More specifically, the invention relates to a backshell capable of connecting an overall-shielded harness including shielded cables to a connector in a reliable way and such that electromagnetic interference is minimized. The invention also relates to a shielded terminated harness and a connection comprising this backshell.

PRIOR ART

In aircrafts, electrical connections are essentially made with electrical harnesses. During the flight of an aircraft, several constraints apply directly or indirectly to electrical harnesses, particularly in engine areas. These constraints can be mechanical, electrical, or environmental.

Mechanical constraints (such as vibrations), for instance, can damage the ends of the harness and/or cause wear, breakage, or deterioration of the connection that could result in an undesirable contact resistance.

Furthermore, the electrical installation of a system must comply with electromagnetic compatibility (EMC) requirements, that is, it must be able to function in an environment without disrupting the systems already present in that environment, and without being disrupted by those systems or by external disturbances such as lightning, a strong electromagnetic field (radar), etc.

To this end, electrical connections generally have shielding for attenuating received or transmitted interference. The shielding can be on an individual cable (shielding) and/or on the bundle/harness assembly (overall-shielding). In order to provide for EMC protection of a system, the electromagnetic shielding must cover all the areas of the harness between housings containing equipment items. The use of these backshells assembled to electrical connectors must be capable of meeting the electrical and mechanical requirements.

These connectors must perform both mechanical functions, i.e. be designed to withstand vibrations in the harshest areas and meet integration needs such as harness orientation, as well as perform electrical functions, such as shielding continuity of the cables, electromagnetic protection of the harness, and effective EMC, all with the lowest possible transfer impedance.

Application U.S. Pat. No. 5,052,947 discloses a backshell (shielding termination) for an overall-shielded harness including shielded cables. The backshell comprises a sleeve and an attachment ring. The overall-shielding of the harness is connected to an area at the back of the sleeve and is secured to the latter by a clamping ring. The cables pass through the inside of the sleeve. The ends of the cables have their conducting parts exposed. However, the shielding terminations of the cables pass through the through-holes to the outside and then reach an area at the front of the sleeve to which they are secured by means of a clamping ring. The backshell also comprises an attachment ring movably mounted at the front end of the sleeve. The assembly forms a harness with terminated shielding for connection to a connector.

However, the additional local thickness of the shielding terminations leaves "openings" between the wall of the backshell and the clamping ring when the latter is tightened. When this terminated shielding harness is installed on a connector, electromagnetic interference can pass through these openings and then into the through-holes of the sleeve, and generate interference on cables. The protective sheath (boot) provided is not capable of shielding against this interference. Consequently, protection against EM interference is not satisfactory, this backshell is not optimal in terms of EMC, and the transfer impedance is relatively high.

What's more, with certain backshells, to facilitate carrying the shielding terminations on the sleeve, slots extending from the toothed ring to the holes are provided. The result is that the ring is not complete, consequently implying non-uniform electrical continuity and a high contact resistance. Sometimes the sleeve is made of several parts, which also results in the overall-shielding connection and shielding (on the connector) not having the desired uniformity of electrical continuity.

There is therefore a need for a backshell capable of connecting an overall-shielded harness, including shielded cables, to a connector in a reliable way and with good electrical continuity and therefore low electrical resistance, so as to minimize electromagnetic interference and ensure a low transfer impedance.

DISCLOSURE OF THE INVENTION

The subject matter of the present invention is therefore to meet the needs and remedy the drawbacks mentioned above by offering a backshell (with shielding termination) to connect an overall-shielded harness including shielded cables, to a connector, the backshell comprising a sleeve and an attachment ring, the sleeve having a wall with a substantially tubular shape defining an internal passage for receiving shielded cables, the wall of the sleeve comprising, from the front end to the back end thereof, an engagement area for engaging with a connector, through-holes distributed circumferentially for receiving the terminations of the cable shielding from the internal passage, a first external area for receiving the terminations of the shielding, an external shoulder, and a second external area for receiving the overall-shielding of the harness, the attachment ring having a wall with a substantially tubular shape defining an annular passage for receiving the sleeve, the wall of the attachment ring comprising, from the front end to the back end thereof, an attachment area for connecting to the connector, a first internal area, and an internal shoulder, the backshell being, arranged in such a way that the attachment ring can slide over the sleeve in a direction going from the back end to the front end of the sleeve to an abutment position in which the internal shoulder of the attachment ring abuts against the external shoulder of the sleeve, the internal area of the attachment ring covering the first external area of the sleeve in the abutment position, the attachment ring thus being arranged to cover the terminations of the shielding, and the engagement area of the sleeve comprising a full ring of teeth for engaging with the connector.

Preferably, the wall of the sleeve, at the front end thereof, has a flared part on which the engagement area and the through-holes are made.

Preferably, the through-holes are located immediately behind the engagement area on a portion of the wall up to 20% of the length of the sleeve from the front end thereof.

Preferably still, the first external area of the sleeve has an outside diameter that is greater than that of the second external area.

Advantageously, the wall of the sleeve comprises a flared intermediate section between the first external area and the second external area.

Preferably, the external shoulder of the sleeve and the internal shoulder of the attachment ring are shaped like a ring.

Preferably still, the sleeve is a single part.

Preferably, the backshell comprises at least one clamping ring for securing the terminations of the shielding by tightening them around the sleeve.

The present invention also proposes a terminated shielding harness including a backshell as described above as well as an overall-shielded harness including shielded cables, the shielded cables being received into the internal passage of the sleeve, the terminations of the cable shielding going to the outside of the sleeve through through-holes and received on the first external area of the sleeve, whereas the overall-shielding is received on the second external area of the sleeve, and the attachment ring is movably mounted so as to slide over the sleeve.

The present invention also proposes a connection between a terminated shielding harness as described above and a connector, the cables being connected electrically to the connector, the engagement area of the sleeve being engaged in an engagement area of the connector, and the attachment ring being connected to an attachment area of the connector, the sleeve and attachment ring of the backshell being in an abutment position.

BRIEF DESCRIPTION OF THE FIGURES

Below are described embodiments of the invention, in reference to the appended drawings, given as non-limiting examples, in which.

In all these figures, the same references may designate identical or similar parts. In addition, for the sake of making the figures more legible, the various parts in the figures are not necessarily shown according to a uniform scale.

DETAILED DESCRIPTION OF PARTICULAR EMBODIMENTS

Figure 1:
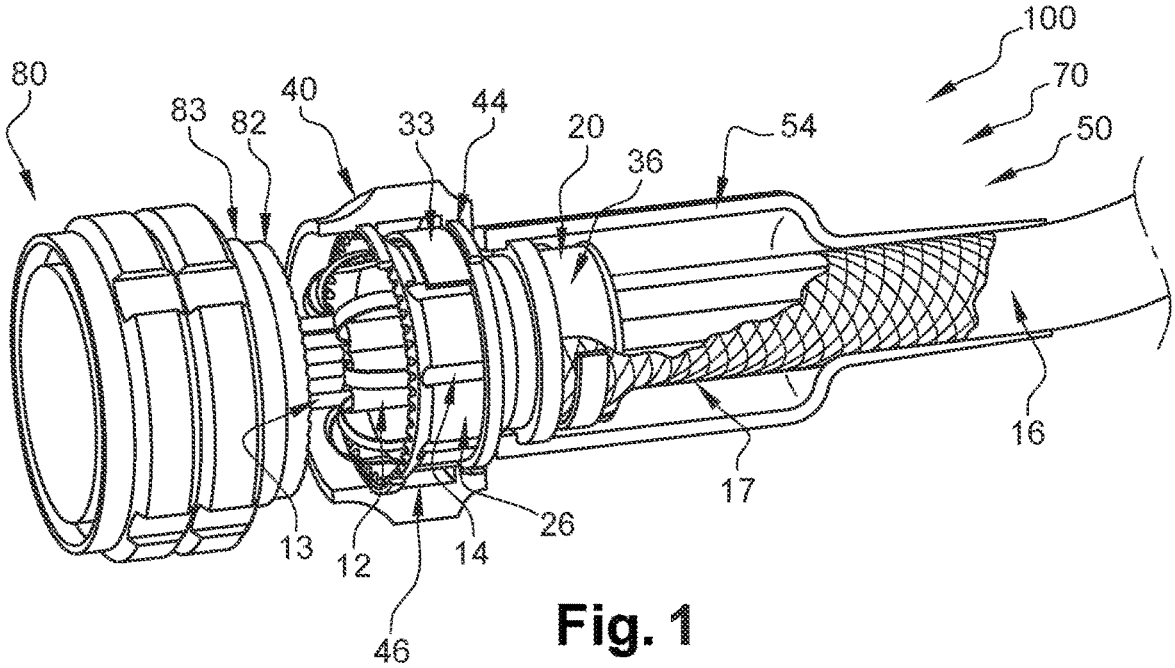
FIG. 1 shows a (partial) cross-sectional view of a terminated shielding harness installed on a backshell according to a first embodiment of the invention.

FIG. 1 shows a first embodiment of backshell 50. It makes it possible to terminate the shielding of a harness 16, forming together with said harness "a terminated shielding harness", 70, for being connected to an electrical connector 80 to make a connection 100. Connector 80 is of a known type, often used in an aircraft.

Figure 2:
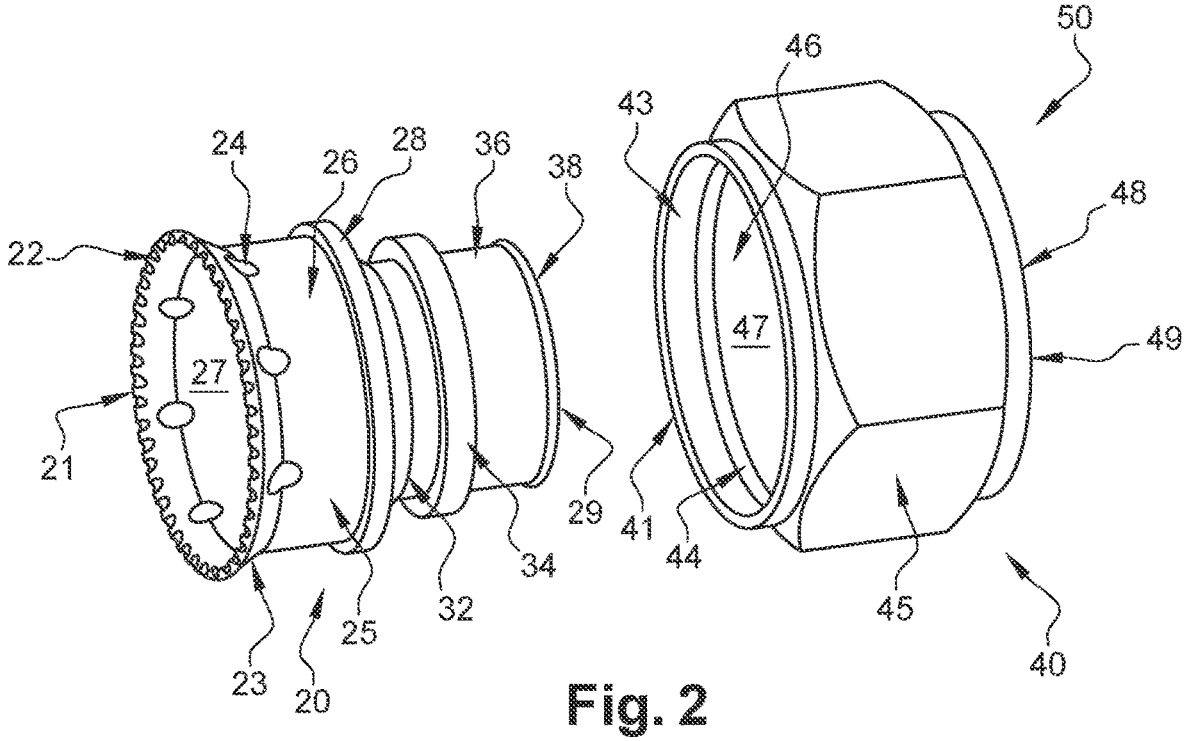
FIG. 2 shows an exploded perspective view of the backshell.
Figure 3:
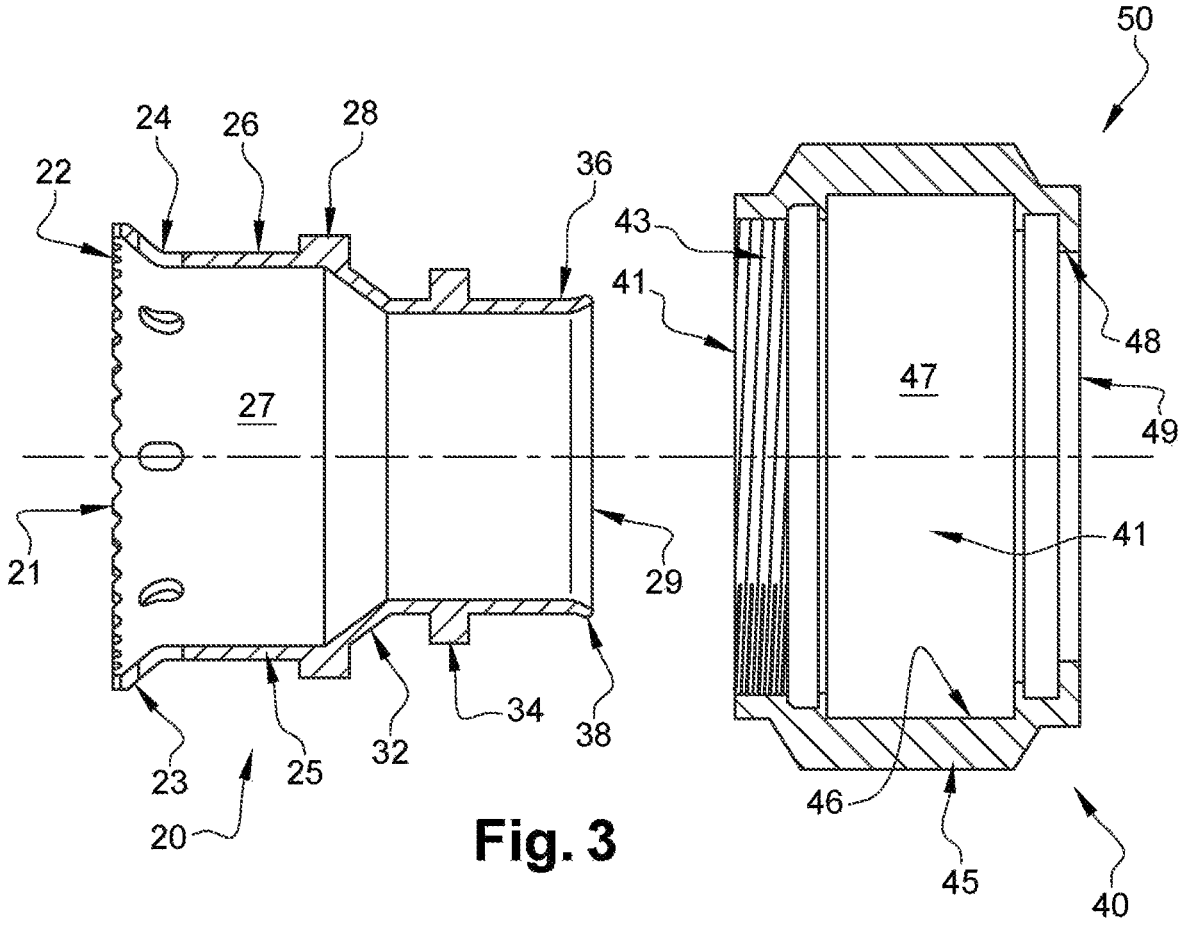
FIG. 3 shows a transverse cross-sectional view of the backshell.

FIGS. 2 and 3 only show the primary parts of backshell 50, that is, a sleeve 20 and an attachment ring 40, as a perspective and as a transverse cross-section, respectively, for an easier understanding of the invention.

Backshell 50 is connected to overall-shielded harness 16 comprising shielded cables 12. It includes a sleeve 20 and an attachment ring 40, shown with attachment ring 40 slid over sleeve 20.

Sleeve 20 includes a wall 25 having substantially tubular shape (with a circular cross-section) extending along a longitudinal axis and defining an internal passage 27. Wall 25 of the sleeve comprises, from its front end 21 (left side in the figures) to its back end 29, an engagement area 22, through-holes 24 distributed circumferentially, a first external area 26, an external shoulder 28, an intermediate section 32, a first rim 34, a second external area 36, and a second rim 38. Sleeve 20 is a single part and is made of an electrically conductive material, typically metal. Sleeve 20 is connected to a harness 16.

Harness 16 is of a known type and includes individual shielded cables 12 that are grouped into a bundle which is surrounded by overall-shielding 17 to protect it against EM interference. Cables 12 and harness 16 may also include layers of insulation by means known per se. In order to connect a harness to a backshell 50 and then a connector 80, this harness must be prepared. By known means, harness 16 is stripped and the shielding is removed at one end, which consists in locally removing the outer insulation and overall-shielding 17 from harness 16. Next, shielded cables 12 of harness 16 are stripped and their shielding is removed at a point closer to the end in order to expose conductive part 13 of cables 12, while keeping the terminations of shielding 14 of the deshielded cables (pig tails) connected to harness 16.

As can be seen in FIG. 1, shielded cables 12 of harness 16 are received into internal passage 27 of sleeve 20. Conductive parts 13 of cables 12, which can be seen toward the end of harness 16, are intended to be plugged into the contacts of connector 80 so as to connect cables 12 electrically to connector 80. However, the terminations of shielding 14 are inserted through through-holes 24 toward the outside of the sleeve and are then folded over toward the back of the sleeve and laid down on first external area 26 so as to be generally aligned substantially with the longitudinal axis.

First area 26 of sleeve 20 is intended to take the terminations of shielding 14. It has a generally cylindrical external surface extending parallel to the longitudinal axis. The terminations of shielding 14 are secured there with an attachment component 33, such as a clamping ring 33. It is conceivable for axial grooves to be provided to better receive the terminations of shielding 14. Toward the back of first area 26 is external shoulder 28, which is in the shape of a ring, protruding radially from wall 25 of sleeve 20. This external shoulder 28 is intended to abut against attachment ring 40 to prevent it from going beyond it, as explained further in the description.

Second external area 36 of sleeve 20 is intended to take overall-shielding 17 of the harness. As in the case of the first area, it has a generally cylindrical external surface that can receive the overall-shielding. This second external area 36 also extends parallel to the longitudinal axis, and allows overall-shielding 17 to be secured to an attachment component, such as a clamping ring. Overall-shielding 17 of harness 16 is not received in internal passage 27 of sleeve 20, but directly on second external area 36.

First rim 34, located in front of second external area 36, is designed primarily as a stop for overall-shielding 17 so that it does not go beyond the rim. A second rim 38 is provided behind second area 36, and more precisely at back end 29 of sleeve 20. When overall-shielding 17 is attached around second area 36 with an attachment component, these two rims, 34 and 38, prevent the overall-shielding from detaching easily.

First external area 26 has an outside diameter that is greater than that of second external area 36. In this embodiment, the diameter of first area 26 is about 1.5 times that of second area 36. In order to integrate these external areas, wall 25 of the sleeve comprises a flared intermediate section 32 between first area 26 and second area 36, which increases in diameter toward front end 21 of sleeve 20.

Wall 25 of sleeve 20 comprises another flared part 23 at its front end 21, with a diameter that increases from first area 26 to front end 21 of sleeve 20. Engagement area 22 and through-holes 24 are located on this flared part 23.

Since through-holes 24 are located on flared part 23, they are angled, facing toward the front and are also at a larger diameter than first area 26. Consequently, not only is it easier to handle the terminations of shielding 14 during insertion into through-holes 24, in addition they lay more naturally on first area 26 in alignment with the longitudinal axis. This therefore allows for a more uniform distribution of the terminations of shielding 14 on sleeve 20.

Furthermore, one can observe that through-holes 24 are located right behind engagement area 22, that is, just behind toothed ring 22. This is in a region starting at front end 21 of sleeve 20 and going to 20%, and preferably even just 10%, of the length of sleeve 20. The first advantage of being located in this region is that the shielding can be left on each cable 12 closer to connector 80. In other words, only the parts of cables 12 to be plugged into connector 80 are deshielded, which keeps the crosstalk between conductive parts 13 of harness 16 down to a minimum, thus ensuring good EMC.

The second advantage is that the terminations of shielding 14 surround sleeve 20 up to the connection thereof to connector 80, thus improving the EM protection of cables 12 within said connector. Lastly, since the terminations of shielding 14 are closer to front end 21 of sleeve 20, they are also easier to see and handle when inserting into through-holes 24, compared to when the holes are deeper in the sleeve.

Since these through-holes 24 are distributed circumferentially and uniformly over wall 25 of sleeve 20, the terminations of shielding 14 are consequently also distributed uniformly around sleeve 20. Although this is not required, through-holes 24 are advantageously located in the same plane perpendicular to the longitudinal axis. For practical reasons having to do with inserting the terminations of shielding 14, a small portion of each of these through-holes 24 can be made in first area 26.

On front end 21 of sleeve 20 is located an engagement area 22 in the form of a toothed ring 22. The teeth provide for better engagement on a broader surface with connector 80, which is also provided with an engagement area 82 in the form of a toothed ring 82. Furthermore, this engagement prevents rotation between sleeve 20 (and therefore harness 16) and connector 80 once the connection is made.

It is important to note that toothed ring 22 is complete, i.e. it consists of a complete circle. There are no slots and no missing teeth. When this toothed ring 22 engages with that of connector 80, a good connection is achieved with minimal electrical resistance and with uniform electrical continuity.

Attachment ring 40 comprises a wall 45 having a substantially tubular shape extending along the longitudinal axis, defining an annular passage 47. Wall 45 of attachment ring 40 comprises, from its front end 41 to its back end 49, an attachment area 43, an internal area 46, and an internal shoulder 48. Attachment ring 40 is a single part and is made of an electrically conductive material, typically metal.

Once again in reference to FIG. 1, attachment ring 40 is installed around sleeve 20, both of which are oriented in the same direction with sleeve 20 received into annular passage 47 of attachment ring 40. It is arranged in such a way that it can slide over sleeve 20 in a direction going from back end 29 toward front end 21 of the sleeve, and this up to an abutment position (shown) in which internal shoulder 48 of attachment ring 40 abuts against external shoulder 28 of sleeve 20. Internal shoulder 48 is in the shape of a ring, protruding radially from wall 45 of attachment ring 40. Attachment ring 40 is shown in front of a connector 80 for its connection to the latter.

One can observe that in the abutment position, internal area 46 of attachment ring 40 covers first external area 26 of sleeve 20. Consequently, the terminations of shielding 14 are completely covered by attachment ring 40, which provides protection against EM interference. Unlike the prior art, electromagnetic interference cannot enter via openings or through-holes in the sleeve. The assembly including internal area 46, internal shoulder 48, and attachment area 43 of attachment ring 40 surrounds the terminations of shielding 14 and beyond front end 21 of sleeve 20. Indeed, backshell 50 is arranged so that, once connected to connector 80, the attachment ring completely surrounds the terminations of shielding 14, engagement area 22 of sleeve 20, and engagement area 82 of connector 80, as well as attachment area 83 thereof.

It must also be noted that, the fact that attachment ring 40 can slide in relation to sleeve 20 allows it to be removed when the terminations of shielding 14 are inserted into through-holes 24, and then to be put back in place.

In order to provide for/improve the sealed condition, O-rings 44 are used advantageously. They are placed right next to internal shoulder 48 and in front of internal area 46 of attachment ring 40. If necessary, internal circumferential grooves may be provided to house O-rings 44. These O-rings 44 are arranged so as to be placed between attachment ring 40 and sleeve 20, and between attachment ring 40 and connector 80. As a supplement, a protective sheath (boot) 54 can cover sleeve 20 from the first rim 34 thereof to beyond back end 29 thereof, up to a part of harness 16. The assembly including O-rings 44 and protective sheath 54 makes it possible to seal the connection.

Backshell 50 of the invention performs better than known backshells, above all by making it possible to achieve a reliable connection 100 between an overall-shielded harness 16 including shielded cables and a connector 80. The terminations of shielding 14 of cables 12 are distributed uniformly around sleeve 20 and come very close to front end 21 of sleeve 20. What's more, they are completely covered by attachment ring 40 when it is in the abutment position. Furthermore, backshell 50 is made of two main components, each of which is a single part. Furthermore, sleeve 20 comprises a full toothed ring 22.

The connection of overall-shielding 17 and of the terminations of shielding 14 to sleeve 20 prevents forces from being applied directly to conductive parts 13 plugged into connector 80. The distribution and positioning of the terminations of shielding 14 on backshell 50 provide for better electrical continuity and a reduced transfer impedance. Since backshell 50 consists of only two main components, it is easier to install on a harness 16 and less likely to be lost. In addition, connection of overall-shielding 17 and of shielding 14 (to the connector) is achieved by means of a single conductive part affording much better electrical continuity than a sleeve consisting of a plurality of parts. The result is that backshell 50 performs better in terms of EMC.

The invention has been described in connection with an overall-shielded harness including shielded cables. However, the invention is also appropriate for other cables, such as a non-overall-shielded harness with shielded cables, or even a single shielded cable.

Naturally, the invention can be used at the same time as other known means of protection against EM interference. Also, the backshell of the invention can be retrofitted to connections already present in the aircraft.

In a variant, the intermediate section can be a flange perpendicular to the axis and can incorporate, as applicable, the external shoulder of the sleeve.

The invention claimed is:

1. A backshell for connecting an overall-shielded harness comprising shielded cables to a connector, the backshell comprising a sleeve and an attachment ring, the sleeve having a wall with a substantially tubular shape defining an internal passage for receiving shielded cables, the wall of the sleeve comprising, from the front end to the back end thereof, an engagement area for engaging with a connector, through-holes distributed circumferentially for receiving the terminations of the cable shielding from the internal passage, a first external area for receiving the terminations of the shielding, an external shoulder, and a second external area for receiving the overall-shielding of the harness, the attachment ring having a wall with a substantially tubular shape defining an annular passage for receiving the sleeve, the wall of the attachment ring comprising, from the front end to the back end thereof, an attachment area for connecting to a connector, a first internal area, and an internal shoulder, the backshell being arranged in such a way that the attachment ring can slide over the sleeve in a direction going from the back end to the front end of the sleeve, to an abutment position in which the internal shoulder of the attachment ring abuts against the external shoulder of the sleeve, wherein, in the abutment position, the internal area of the attachment ring covers the first external area of the sleeve, the attachment ring being thus arranged to cover the terminations of the shielding, and the engagement area of the sleeve is a full toothed ring for engaging with the connector.

2. The backshell according to claim 1, wherein the wall of the sleeve has, at the front end thereof, a flared portion on which the engagement area and the through-holes are made.

3. The backshell according to claim 1, wherein the through-holes are located immediately behind the engagement area on a portion of the wall up to 20% of the length of the sleeve from the front end thereof.

4. The backshell according to claim 1, wherein the first external area of the sleeve has an outside diameter that is greater than that of the second external area.

5. The backshell according to claim 4, wherein the wall of the sleeve comprises a flared intermediate section between the first external area and the second external area.

6. The backshell according to claim 1, wherein the external shoulder of the sleeve and the internal shoulder of the attachment ring are in the shape of a ring.

7. The backshell according to claim 1, wherein the sleeve is a single part.

8. The backshell according to claim 1, wherein the backshell comprises at least one clamping ring for securing the terminations of the shielding by clamping them around the sleeve.

9. A terminated shielding harness comprising a backshell according to claim 1, as well as an overall-shielded harness comprising shielded cables, the shielded cables being received into the internal passage of the sleeve, the terminations of the cable shielding going to the outside of the sleeve through through-holes and received on the first external area of the sleeve, whereas the overall-shielding is received on the second external area of the sleeve, and the attachment ring is movably mounted so as to slide over the sleeve.

10. A connection between a terminated shielding harness according to claim 9 and a connector, the cables being connected electrically to the connector, the engagement area of the sleeve being engaged in an engagement area of the connector, and the attachment ring being connected to an attachment area of the connector, the sleeve and attachment ring of the backshell being in an abutment position.

* * * * *